US005396149A

United States Patent [19]

Kwon

[11] Patent Number: 5,396,149

[45] Date of Patent: Mar. 7, 1995

[54] COLOR PLASMA DISPLAY PANEL

[75] Inventor: Ki-duck Kwon, Seoul, Rep. of Korea

[73] Assignee: Samsung Electron Devices Co., Ltd., Kyungki-Do, Rep. of Korea

[21] Appl. No.: 950,492

[22] Filed: Sep. 25, 1992

[30] Foreign Application Priority Data

Sep. 28, 1991 [KR] Rep. of Korea ..... 91-17015

[51] Int. Cl.[6] ..... H01J 61/35; G09G 3/36

[52] U.S. Cl. ..... 313/486; 313/493; 313/586; 345/65; 345/72

[58] Field of Search ..... 340/771–779; 313/582–587, 609, 610, 483–493; 345/65, 67, 60, 71, 72, 88; 357/885

[56] References Cited

U.S. PATENT DOCUMENTS

| | | | |
|---|---|---|---|
| 3,800,186 | 3/1974 | Yamane et al. | 345/65 |
| 3,882,342 | 5/1975 | Kamegaya et al. | 313/585 |
| 3,886,395 | 5/1975 | Eukushima et al. | 313/585 |
| 3,921,021 | 11/1975 | Glaser et al. | 345/71 |
| 4,005,402 | 1/1977 | Amano | 340/324 |
| 4,021,695 | 5/1977 | Kamegaya et al. | 313/585 |
| 4,047,077 | 9/1977 | Veith | 340/775 |
| 4,130,778 | 12/1978 | Branston | 345/67 |
| 4,144,375 | 3/1979 | Ernthausen | 313/586 |
| 4,162,427 | 7/1979 | Kamegaya et al. | 345/72 |
| 4,429,303 | 1/1984 | Aboelfotoh | 313/586 |
| 4,533,913 | 8/1985 | Tezucar et al. | 340/775 |
| 4,562,434 | 12/1985 | Amano | 340/775 |
| 4,626,071 | 12/1986 | Wada et al. | 359/885 |
| 4,692,662 | 9/1987 | Wada et al. | 313/587 |
| 5,001,393 | 3/1991 | Kim | 313/586 |
| 5,086,297 | 2/1992 | Miyake et al. | 340/772 |
| 5,216,414 | 6/1993 | Fukutani et al. | 345/88 |

*Primary Examiner*—Richard Hjerpe
*Assistant Examiner*—Steven J. Saras
*Attorney, Agent, or Firm*—Leydig, Voit & Mayer

[57] ABSTRACT

This disclosure relates to a color PDP comprising a plurality of striped color filters formed in parallel on the inner surface of a front plate, a plurality of dielectric layers formed on the color filters and having a plurality of light-passing holes formed at predetermined intervals on those portions corresponding to respective color filters, a white fluorescent layer formed on the dielectric layer, and a plurality of anodes formed on the white fluorescent layer corresponding to the color filters and each having light-passing openings formed on the portion corresponding to respective light-passing holes of the dielectric layer, thereby preventing optical crosstalk between adjacent cathodes in the direction of a scanning line and obtaining uniform luminance.

14 Claims, 2 Drawing Sheets

COLOR PLASMA DISPLAY PANEL

BACKGROUND OF THE INVENTION

The present invention relates to a color plasma display panel (PDP), and more particularly to a color PDP capable of realizing a picture having uniform brightness.

Due to their potentially large-size and longer life than CRTs, and their relatively simple structure and ease of manufacture in general, PDPs have been actively studied, with many new products coming onto the market. Such a PDP is divided into monochrome and color types, according to their display capabilities.

The color PDP excites fluorescent material with ultraviolet rays generated during the discharge of a gas around a positive column, to emit a desired color. Accordingly, a fluorescent layer having a desired color is formed around the discharging region. The fluorescent layer is formed on the side of barrier ribs placed inside a front plate or between front and rear plates. A PDP having a fluorescent layer on its barrier ribs is disclosed in U.S. Pat. No. 4,005,402.

A conventional PDP is illustrated in FIG. 1 forming a fluorescent layer on its barrier ribs. A plurality of striped secondary anodes 14 are formed inside a rear plate 11, and a dielectric layer 15 is formed on secondary anodes 14 as a whole. A plurality of parallel striped cathodes 13 are formed on dielectric layer 15. A plurality of striped anodes 12 are formed parallel to each other by a predetermined distance on a front plate 10, to be orthogonal to cathodes 13. Barrier ribs 16 are arranged between anodes 12 and in the same direction to prevent crosstalk, with a fluorescent layer 17 formed on both sides of each barrier rib.

In a conventional color PDP, a discharging unit for a trigger discharge or a secondary discharge disclosed in U.S. Patent No. 4,562,434 is added to the PDP disclosed in U.S. Pat. No. 4,005,402. That is, a trigger discharge is caused between secondary anode 14 and cathodes 13 having dielectric layer 15 therein, so that a plurality of wall charges are formed on the surface of the dielectric. The wall charges lower the breakdown voltage required for initiating discharge, to facilitate a prompt and easy display discharge between the main anodes and cathodes.

However, while a color PDP realizes a color picture by the light having a predetermined color emitted from R, G and B fluorescent layers, a luminance difference occurs according to the emitting efficiency of each fluorescent layer, so that proper picture color cannot be obtained. Meanwhile, since the barrier ribs are formed in only one direction, an optical crosstalk is generated between pixels in the lengthwise direction of the barrier ribs, and picture quality is degraded.

SUMMARY OF THE INVENTION

The object of the present invention is to provide a color PDP capable of realizing a picture having uniform brightness throughout the screen, wherein its structure can reduce the luminance difference of a color according to the different emitting efficiency of a fluorescent material.

Another object of the present invention is to provide a color PDP which can realize a good quality picture and has a structure where an optical crosstalk between pixels is reduced.

To simultaneously achieve the above objects of the present invention, there is provided a color PDP comprising:

front and rear plates having a predetermined distance therebetween to provide an inner discharge space;

a plurality of barrier ribs placed in parallel between the front and rear plates;

a plurality of striped color filters formed in parallel on the inner surface of the front plate;

a plurality of first dielectric layers formed on the inner surface of the front plate and on the color filter, and having a plurality of light-passing holes at predetermined intervals on the portions corresponding to respective color filters;

a white fluorescent layer formed on the first dielectric layer corresponding to the color filter;

a plurality of striped anodes formed in parallel on the white fluorescent layer corresponding to the respective color filters, and each having light passing openings formed on the portions corresponding to respective light-passing holes of the dielectric layer;

an auxiliary anode formed inside the rear plate;

a second dielectric layer placed on the auxiliary anode; and a plurality of striped cathodes formed in parallel on the second insulating layer, so as to be perpendicular to the anodes.

Since red, green and blue light of a color filter are separated from a white light emitted from the white fluorescent layer, the red, green and blue colors can obtain a uniform luminance. Also, since only the portion of the fluorescent layer which is exposed in respect to the passing hole formed in the anode, is excited, the optical crosstalk between adjacent pixels in the direction of scanning lines are restrained, so that the color purity is improved to get a clear picture.

BRIEF DESCRIPTION OF THE DRAWINGS

Further features and advantages will become more apparent from the following and more particular description of the preferred embodiment of the invention as illustrated in the accompanying drawings in which same reference characters generally refer to the like parts throughout the views, and in which.

DETAILED DESCRIPTION OF THE INVENTION

Figure 1:
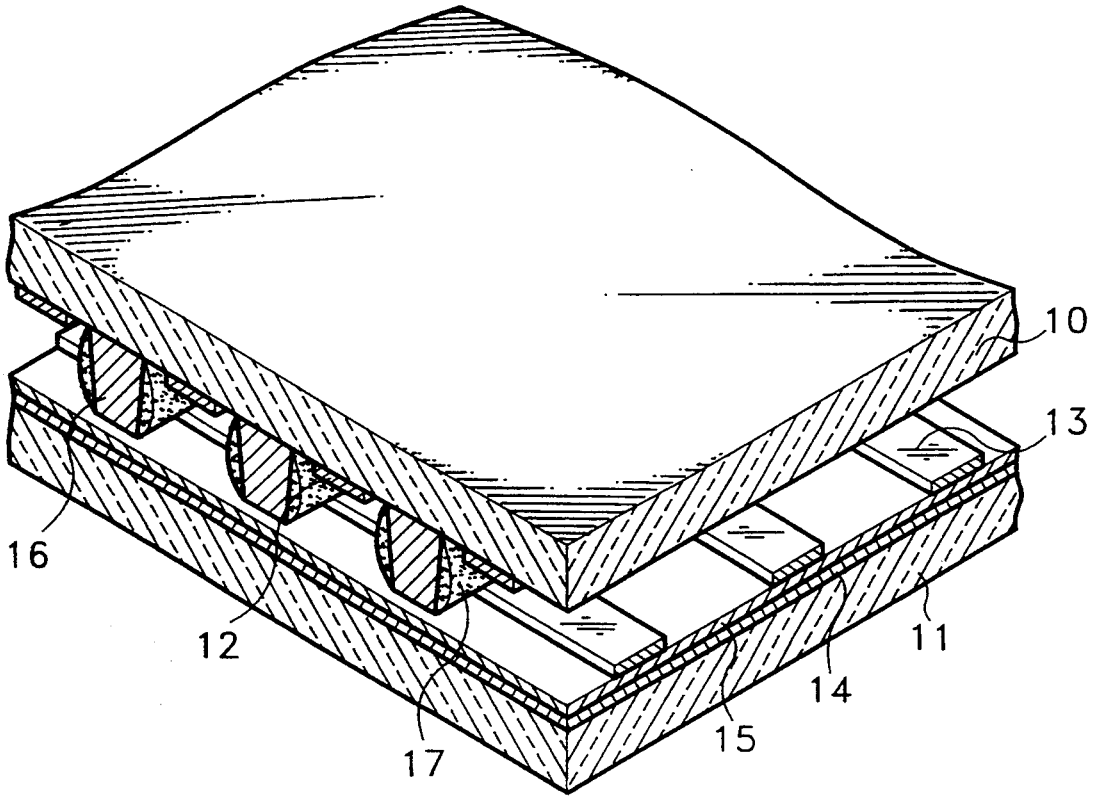
FIG. 1 (PRIOR ART)
FIG. 1 is a partially extracted perspective view of a conventional color PDP.
Figure 2:
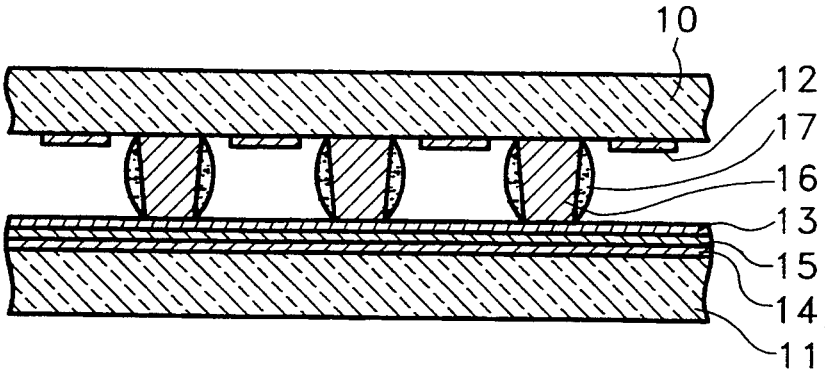
FIG. 2 (PRIOR ART)
FIG. 2 is a schematic sectional view of the color PDP shown in FIG. 1.
Figure 3:
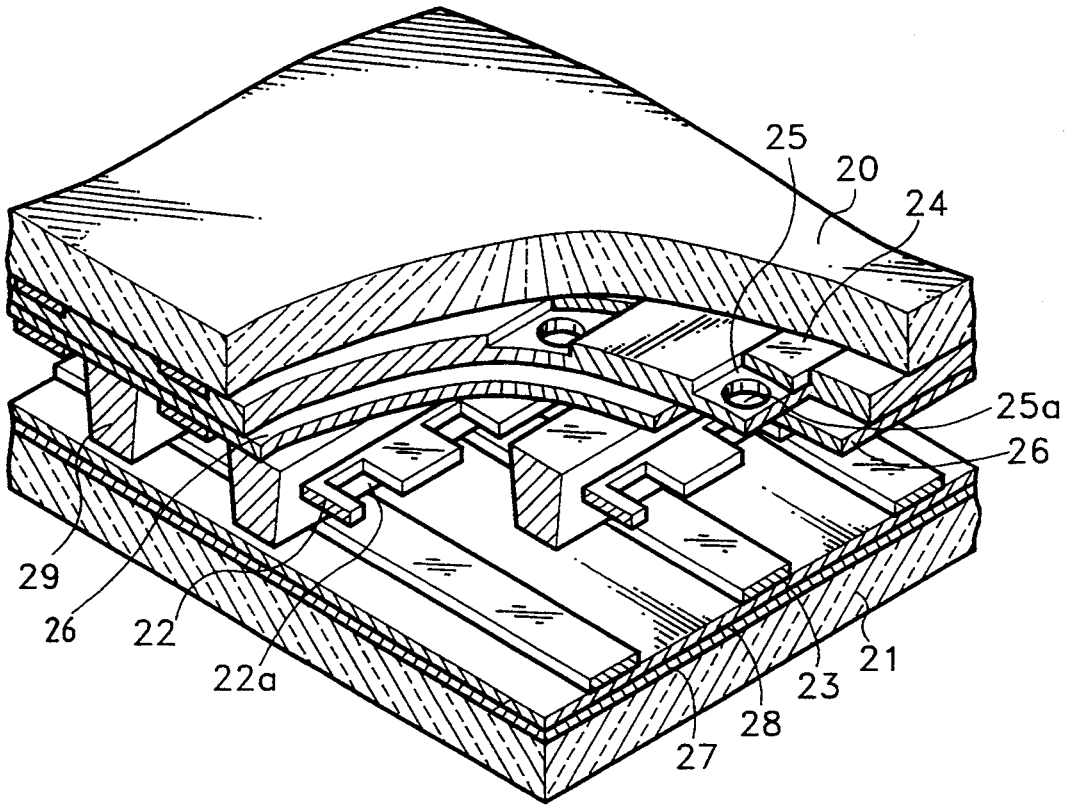
FIG. 3 is a partially cut away and partially extracted perspective view of a color PDP according to the present invention.
Figure 4:
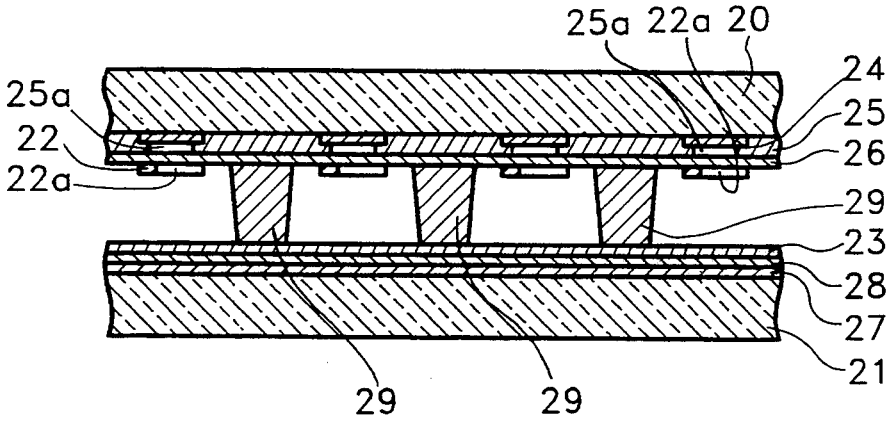
FIG. 4 is a schematic sectional view of the color PDP according to the present invention shown in FIG. 3.

Referring to FIGS. 3 and 4, front and rear plates 20 and 21 are formed so as to oppose each other, and a plurality of barrier ribs 29 for preventing crosstalk having a predetermined height are formed in parallel in a first direction and separated by a predetermined distance between front and rear plates 20 and 21. Further, a striped color filter 24 with a predetermined color is formed on the inner surface of the front plate between barrier ribs 29 and being parallel thereto, a first dielectric layer 25 having a light-passing hole 25*a* corresponding to color filter 24 is formed on the inner surface of the front plate, and a white fluorescent layer 26 is stacked on the overall surface of first dielectric layer 25. Therefore, white fluorescent layer 26 is partially opposed to every color filter 24 via corresponding light-passing holes 25*a*. Also, a plurality of anodes 22 having openings 22*a* as light passing regions corresponding to each light-passing hole 25*a* are formed at predetermined intervals on white fluorescent layer 26 and directly below color filter 24.

Meanwhile, an auxiliary anode 27, a second dielectric layer 28 and cathodes 23 are sequentially formed on the inner surface of rear plate 21. A plurality of cathodes 23 are formed as parallel stripes in a second direction being perpendicular to the first direction. Color filter 24 is a bandpass filter for visible light frequencies of a desired color, which can pass the red, green and blue light beams in order to realize a picture having a natural color. Here, adjacent filters show different colors, e.g., red, green and blue, thereby realizing a picture having a natural color composition.

In the above structure, the auxiliary anode is formed in a single layer, or formed into stripes opposing the cathodes, as disclosed in U.S. Pat. No. 4,562,434.

Meanwhile, the white fluorescent layer covers the entire inner surface of the first dielectric layer, and can also be formed as stripes on the required portions corresponding to the color filters. The light-passing region placed on the anode is formed due to the opening formed into the edges of the anodes, as illustrated in FIG. 3, and can also be a cylindrical passing hole as are the light-passing holes formed on the first dielectric layer. Such modifiable elements as mentioned above are selectively combined to obtain an improved PDP different from that illustrated in the embodiment.

The color PDP according to the present invention is operated as follows.

Firstly, when a trigger voltage is supplied to auxiliary anodes 27 and cathodes 23, a small discharge occurs to accumulate a wall charge on dielectric layer 28. Successively, when a display voltage is supplied to anodes 22 and cathodes 23, the insulating state in the space is broken down, resulting in a display discharge and the formation of a pixel. When the display discharge is initiated, the wall charge of dielectric layer 28 helps a main discharge to promptly occur under low display-voltage conditions. During main discharging, white fluorescent layer 26 formed on the inner surface of front plate 20 is partially stimulated by a large quantity of ultraviolet rays generated from the main discharge region, corresponding to the discharge region, which generates white light. The white light generated from the white fluorescent layer is incident to color filter 24 via the beam passing openings of anodes 22 and light-passing hole 25*a* of first dielectric layer 25. Accordingly, when the white light passes through color filter 24, light outside its passband is absorbed, and only that within a predetermined band is passed, to obtain displayed light having a predetermined color. Color filter 24 has its own light-passing bandwidth to pass only red or blue or green light.

As above, unlike an ordinary PDP, the color PDP according to the present invention excites the white fluorescent layer with a discharge light to obtain a white light, and passes the white light through a filter of a predetermined passband, to obtain separated red, blue and green displayed light. According to the present invention as above, the luminance difference between pixels are greatly reduced, thereby improving the color of the whole picture by the luminance difference according to color. Also, by changing the light transmittivity of color filter 24 properly, the luminance difference between pixels is improved. Furthermore, by changing the shape of light-passing hole 25*a* formed on dielectric layer 25, desired pixel shape, e.g., cylindrical, can be easily obtained.

Meanwhile, during discharging, only the portion of white fluorescent layer 26 which is exposed to the discharge space is partially excited by ultraviolet rays via opening 22*a* of anode 22, so that the optical crosstalk between pixels are lowered.

According to the present invention as above, uniform luminance can be obtained throughout the screen, while realizing red, green and blue colors using a white fluorescent layer only. Also, the optical crosstalk between adjacent pixels in the direction of scanning lines, is restrained, to realize a picture having high color purity.

Having described a preferred embodiment of the present invention, it will be clear to those skilled in the art that modifications and alternatives to the disclosed apparatus exist within the scope and spirit of the present invention. Accordingly, it is intended to limit the scope of the present invention only as indicated in the following claims.

What is claimed is:

1. A color plasma display panel (PDP) comprising:

a first plate;

a second plate spaced from the first plate and defining an inner discharge space between the first and second plates;

a plurality of parallel barrier ribs disposed between the first and second plates;

a plurality of parallel striped color filters disposed adjacent to an inner surface of the first plate;

a plurality of first dielectric layers disposed adjacent to the striped color filters and adjacent to the inner surface of the first plate, the plurality of first dielectric layers having a plurality of light-passing holes disposed at predetermined intervals respectively opening to the striped colors filters;

a white fluorescent layer disposed adjacent to the first dielectric layers;

a plurality of parallel striped anodes disposed adjacent to the white fluorescent layer, each of the striped anodes having light-passing openings for respectively passing light through the light-passing holes of the first dielectric layers;

an auxiliary anode disposed adjacent to an inner surface of the second plate;

a second dielectric layer disposed adjacent to the auxiliary anode; and a plurality of parallel striped cathodes disposed adjacent to the second dielectric layer substantially perpendicular to the plurality of striped anodes.

2. The color PDP as claimed in claim 1 wherein the white fluorescent layer is disposed on the inner surface of the first plate as a single layer.

3. The color PDP as claimed in claim 2 wherein each of the light-passing openings of the striped anodes is a cylindrical hole.

4. The color PDP as claimed in claim 2 wherein the auxiliary anode is disposed on the second plate as a single layer.

5. The color PDP as claimed in claim 4 wherein each of the light-passing openings of the striped anodes is a cylindrical light-passing hole.

6. The color PDP as claimed in claim 2 wherein the auxiliary anode includes a plurality of parallel stripes.

7. The color PDP as claimed in claim 6 wherein each of the light-passing openings of the striped anodes is a cylindrical light-passing hole.

8. The color PDP as claimed in claim 6 wherein the white fluorescent layer includes a plurality of stripes respectively corresponding to the striped color filters.

9. The color PDP as claimed in claim 6, wherein the white fluorescent layer is disposed on the inner surface of the first plate as a single layer.

10. The color PDP as claimed in claim 6 wherein each of the light-passing openings of the striped anodes is a cylindrical light-passing hole.

11. The color PDP as claimed in claim 10 wherein the plurality of parallel stripes of said auxiliary anodes are disposed on second plate in a single layer.

12. The color PDP as claimed in claim 9 wherein each of the light-passing openings of the striped anodes is a cylindrical light-passing hole.

13. The color PDP as claimed in claim 1 wherein the plurality of striped color filters are respectively red, blue, and green color passband filters.

14. A color plasma display panel comprising:

a first plate;

a second plate spaced from the first plate and defining a discharge space between the first and second plates;

a white fluorescent layer disposed adjacent to the first plate for generating white light;

a first color passband filter disposed between the white fluorescent layer and the first plate for filtering the white light and passing red light;

a second color passband filter disposed between the white fluorescent layer and the first plate for filtering the white light and passing green light;

a third color passband filter disposed between the white fluorescent layer and the first plate for filtering the white light and passing blue light;

a layer having first, second, and third light-passing holes respectively opening to the first, second, and third color passband filters and disposed between the white fluorescent layer and the first plate, the first, second, and third light-passing holes respectively shaping light passed by the first, second, and third color passband filters;

a plurality of cathodes disposed adjacent to the second plate;

a plurality of anodes disposed adjacent to the white fluorescent layer for generating ultraviolet light in the discharge space for stimulating the white fluorescent layer.

* * * * *